United States Patent [19]

Knox et al.

[11] Patent Number: 4,663,782

[45] Date of Patent: May 12, 1987

[54] BLOUSE

[76] Inventors: William G. Knox; Margaret L. Turner, both of P.O. Box 1505, Kihei, Hi. 96753

[21] Appl. No.: 835,261

[22] Filed: Mar. 3, 1986

[51] Int. Cl.[4] ..... A41D 1/20

[52] U.S. Cl. ..... 2/104

[58] Field of Search ..... 2/104

[56] References Cited

U.S. PATENT DOCUMENTS

| | | | |
|---|---|---|---|
| 4,004,294 | 1/1977 | Pinch | 2/104 |
| 4,458,365 | 7/1984 | Wood | 2/104 |
| 4,566,136 | 1/1986 | Echols | 2/104 |

FOREIGN PATENT DOCUMENTS

| | | | |
|---|---|---|---|
| 682391 | 2/1930 | France | 2/104 |

*Primary Examiner*—Doris L. Troutman

*Attorney, Agent, or Firm*—Harvey B. Jacobson

[57] ABSTRACT

Breast feeding blouses are designed to provide minimum exposure of a wearer's breast during feeding. In one form of the invention, a blouse has a pair of pocket size openings for the wearer's breasts, and flaps for covering the openings. Each flap is secured along a top portion thereof to the garment above the respective opening for upward raising of the flap to uncover the opening only to the extent necessary for an infant to obtain access to the wearer's nipple. Another form of breast feeding garment has a pair of substantially horizontal slits for providing access to the wearer's breasts for feeding and a downwardly depending horizontal pleat for covering the slits and providing access thereto by lifting portions of the pleat. The flaps or pleat, as the case may be, may have loop and pile-type friction fastener strips for securing same to the garment in a down position.

2 Claims, 6 Drawing Figures

BLOUSE

BACKGROUND OF THE INVENTION

Field of the Invention

This invention relates to women's outer garments, particularly blouses, shirts, dresses or like tops which are particularly suited for use by a breast feeding mother.

A nursing or breast feeding mother, particularly in the early infancy stages, is usually anxious to move from maternity wear into more conventional clothing. However, while a variety of garments have been available specifically designed for breast feeding, these tend to be unattractive. Another consideration is that of exposure of the mother's breast, commonly making breast feeding embarassing to a new mother in public or semi-public situations.

One earlier proposal for a nursing garment which purports to alleviate the breast exposure problem is disclosed in U.S. Pat. No. 4,004,294 to Pinch, issued Jan. 25, 1977. This proposal consists in a garment which simulates a conventional blouse or the like with a pair of breast pockets. The pocket portions, however, in fact are flaps which normally cover openings in the blouse, the flaps being secured to the blouse along their bottom edges. The flaps may be raised to cover the respective openings and releasably secured in raised position by loop and pile fasteners or the like, so as to disguise the garment as a conventional blouse, or they may be lowered to expose the wearer's breast for feeding. With this construction, however, to expose the wearer's nipple, it is generally necessary to drop one of the flaps all the way down, uncovering the entire opening that it normally covers, and thereby exposing to view a large part, if not all of the wearer's breast.

It is a particular object of this invention to provide a breast feeding garment which simulates a conventional garment when required, but which can be converted to provide effective access to a wearer's breast for feeding purposes, while exposing a minimum thereof to view.

SUMMARY OF THE INVENTION

A breast feeding garment in accordance with the invention simulates a blouse, dress or other top, but has a pair of openings for the wearer's breast, and flaps for covering the respective openings, which flaps are secured to the garment along their upper edges so that a flap is opened upwardly to uncover the opening and expose the wearer's breast, rather than downwardly as in the Pinch patent. With this arrangement, in contrast to Pinch, a flap need only be opened to the extent necessary for an infant to obtain access to the nipple, leaving the remainder of the breast covered. The opened portion of a flap may be secured in an elevated position during feeding, or may even be allowed to flap down provided it is not troublesome to the infant, thereby exposing even less of the wearer's breast.

The openings may be pocket size, in which case the flaps may be formed themselves as pockets, or alternatively the openings may be horizontal slits and the flaps may be formed on a pleat or tuck which covers the slits. Apart from the opening and flap structure, the garment may be made in any conventional design of top, and may have any fashionable appearance.

These together with other objects and advantages which will become subsequently apparent reside in the details of construction and operation as more fully hereinafter described and claimed, reference being had to the accompanying drawings forming a part thereof, wherein like numerals refer to like parts throughout.

DESCRIPTION OF PREFERRED EMBODIMENTS

Figure 2:
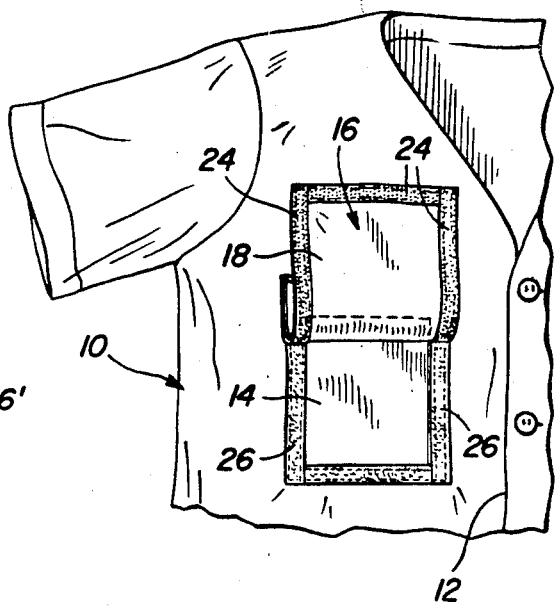
FIG. 2 is an enlarged front elevational view of a part of the blouse, with a breast pocket flap shown in open position.
Figure 3:
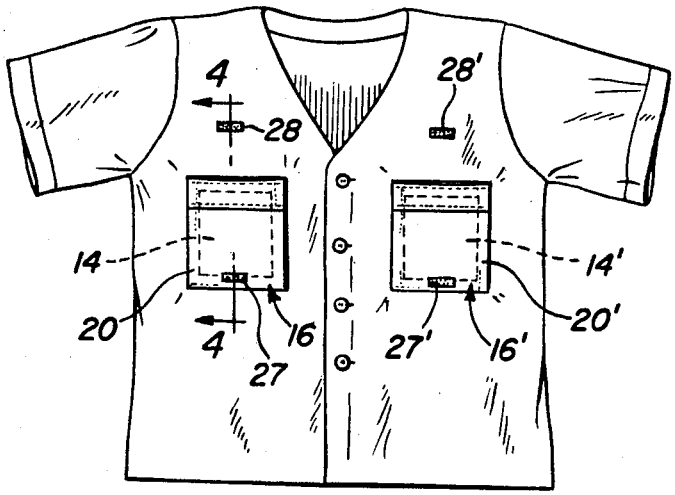
FIG. 3 is a front elevational view of the blouse with the breast pocket flaps closed.
Figure 4:
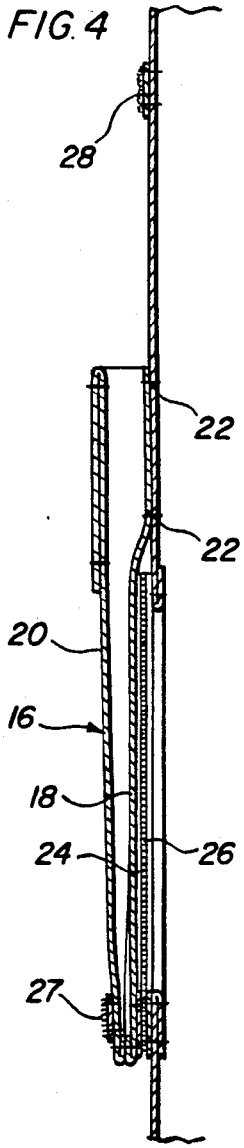
FIG. 4 is an enlarged sectional view on line 4—4 of FIG. 3.

Referring initially to FIGS. 2–4, a breast feeding blouse 10 is patterned generally as a conventional woman's blouse of any known fashion. The blouse may have a button up front 12 and rectangular pocket size openings 14, 14' in the respective breast areas of the blouse front. The openings are provided with respective flaps 16, 16' comprising respective back panels 18, 18' and front panels 20, 20' sewn peripherally together to form a top-opening pocket. The respective back panels may be seamed to the blouse above the respective openings 14, 14' along their top edge portions, as indicated at 22 in FIG. 4. Additionally, the back panels have peripheral strips 24 of a loop and pile fabric for engaging complementary strips 26 secured to the blouse peripherally around the openings 14, 14'.

Figure 1:
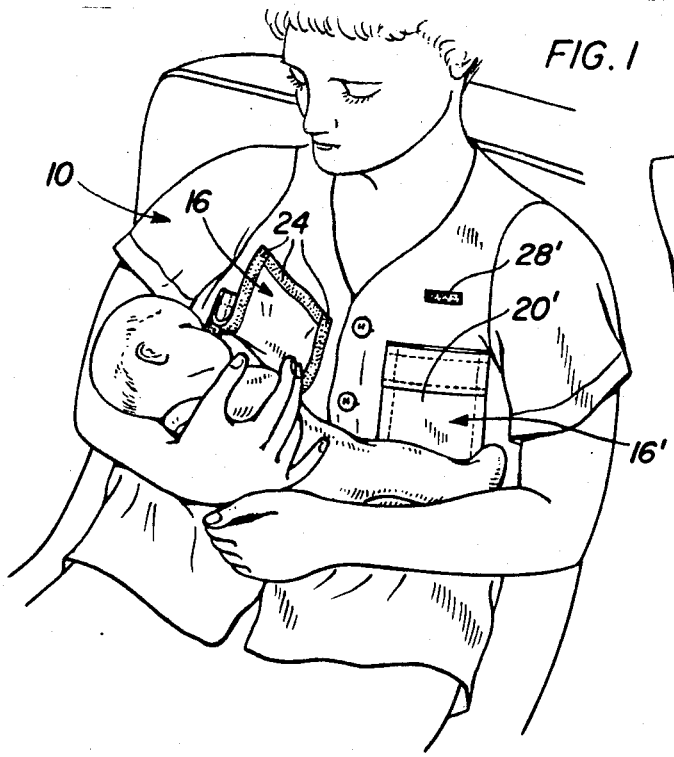
FIG. 1 is an in-use perspective view of a nursing mother wearing a breast feeding blouse in accordance with the invention.

When the flaps 16, 16' are down, with strips 24, 26 in engagement, closing the respective openings 14, 14', the blouse simulates a conventional pocketed garment. For breast feeding, however, as shown in FIG. 1, either flap 16 or 16' may be raised to the extent necessary for an infant to obtain access to the wearer's nipple, by disengaging flap 16 or 16' from the bottom up. Further, the flap need only be opened to the required degree without having to expose the entire opening 14 or 14' and hence revealing more than is necessary of the wearer's breast. In case it is desired to maintain a flap in a raised open position, each flap may be provided with an outer tab 27, 27' of loop and pile fabric adapted to engage a complementary tab 28 or 28' of the fabric secured to the blouse above the respective flap.

Figure 6:
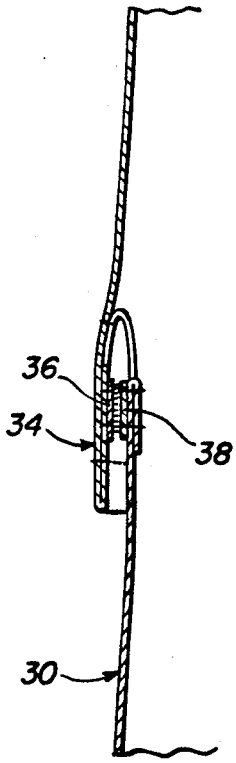
FIG. 6 is a sectional view on line 6—6 of FIG. 5.
Figure 5:
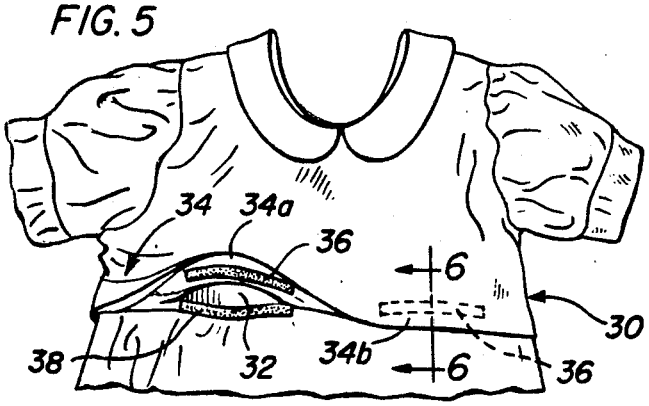
FIG. 5 is a front elevational view of another form of breast feeding blouse in accordance with the invention.

FIGS. 5 and 6 show an alternative form of breast feeding garment 30 in accordance with the invention, having breast openings 32, 32' in the form of horizontal slits. In this case, a horizontal pleat 34 forms respective flap portions **34*a*, 34*b* over the slits, with complementary loop and pile strips 36, 38** for retaining the pleat in a lowered position covering the slits. As previously, the pleat portions can be raised to expose the slits for breast feeding with minimum exposure of the wearer's breast.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A nursing outer garment comprising a fabric member of flexible material covering the front of a woman's torso, said member having a pair of openings therein to enable access to the breasts for feeding an infant, each of said openings having a bottom edge, top edge and side edge, and a closure means for each of said openings, each of said closure means including an upwardly opening pocket of fabric material defined by an inner panel and an outer panel, said panels generally conforming in shape to the opening and having a periphery extending slightly beyond the edges of the openings, said panels being secured together along the bottom edges and side edges with the top edges being free of each other to define an upwardly opening pocket, means fixedly securing the top edge portion of the inner panel to the fabric member just above the top edge of the opening to enable the pocket to swing from a closed position overlying and closing the opening to an open position extending upwardly from the top edge of the opening to provide access to a breast underlying the opening with the pocket being moved toward closed position by gravity for concealing all of breast above the area of contact between a nursing infant and the breast to reduce exposure of the breast to view when nursing an infant in a public place, means releasably securing the side and bottom edges of the inner panel of the pocket to the outer surface of the fabric member alongside the bottom and side edges of the opening with the entire length of the bottom and side edges of the inner panel being retained against the outer surface of the fabric member to completely conceal the breast and means releasably securing the bottom edge of the outer panel of the pocket to the outer surface of the fabric member substantially above the top edge of the opening when the pocket is in open position to provide full access to the breast.

2. The garment as defined in claim 1 wherein both of said securing means includes strips of coacting hook and loop fastener material of flexible construction to enable the fabric member and pockets to conform with the contour of the woman's torso.

* * * * *